US010480315B2

(12) United States Patent
Gottumukkala et al.

(10) Patent No.: US 10,480,315 B2
(45) Date of Patent: Nov. 19, 2019

(54) AVERAGE/INITIAL RESERVOIR PRESSURE AND WELLBORE EFFICIENCY ANALYSIS FROM RATES AND DOWNHOLE PRESSURES

(71) Applicant: Schlumberger Technology Corporation, Sugar Land, TX (US)

(72) Inventors: Varma Gottumukkala, Missouri City, TX (US); Bobby Dale Poe, Jr., Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 269 days.

(21) Appl. No.: 15/017,279

(22) Filed: Feb. 5, 2016

(65) Prior Publication Data

US 2016/0305238 A1 Oct. 20, 2016

Related U.S. Application Data

(60) Provisional application No. 62/112,985, filed on Feb. 6, 2015.

(51) Int. Cl.
*E21B 49/08* (2006.01)
*E21B 47/06* (2012.01)

(52) U.S. Cl.
CPC ..... *E21B 49/087* (2013.01); *E21B 47/065* (2013.01); *E21B 2049/085* (2013.01)

(58) Field of Classification Search
CPC . E21B 49/087; E21B 47/065; E21B 2049/085
See application file for complete search history.

(56) References Cited

U.S. PATENT DOCUMENTS 5,265,015 A 11/1993 Auzerais et al.
6,836,731 B1 * 12/2004 Whalley ..... E21B 49/00 702/13
2005/0116709 A1 * 6/2005 Proett ..... G01N 24/081 324/303
2012/0158310 A1 6/2012 Adams et al.

OTHER PUBLICATIONS

Blasingame et al. ("Type-curve Analysis using the Pressure Integral Method," SPE, 18799, pp. 525-543, 1989) (Year: 1989).*
Torcuk et al. ("Theory and Application of Pressure and Rate Transient Analysis in Unconventional Reservoirs," SPE, 166147, pp. 1-20, 2013) (Year: 2013).*
Nashawi (Transient Analysis for Wells with Variable Sandface Flow Rate, Journal of Canadian Petroleum Technology, vol. 42, No. 7, pp. 44-53, Jul. 2003) (Year: 2003).*
Applicant proposed amendment (Year: 2019).*
Elgmati, A. R., "Analysis of production and pressure data to characterize the performance of oil and gas reservoirs", Doctoral Dissertation, Missouri University of Science and Technology, Fall 2015, 177 pages.

(Continued)

*Primary Examiner* — Yasser A Abdelaziez

(57) ABSTRACT

Systems and methods for calculating reservoir characteristics, including well pressure and flow rates are disclosed. Plotting and monitoring a plot of pressure (p) and flow rate (q) as p/q on a y-axis and 1/q on an x-axis can provide insight into well characteristics with zero RMS error.

17 Claims, 4 Drawing Sheets

(56) References Cited

OTHER PUBLICATIONS

Pratikno, H. et al., "Decline Curve Analysis Using Type Curves—Fractured Wells", SPE 84287, presented at the SPE Annual Technical Conference and Exhibition, Denver, Colorado, USA, 2003, 14 pages.
Search Report Under Section 17(5)(a) in GB Patent Application No. 1602003.4 dated Feb. 20, 2017, 6 pages.

* cited by examiner

AVERAGE/INITIAL RESERVOIR PRESSURE AND WELLBORE EFFICIENCY ANALYSIS FROM RATES AND DOWNHOLE PRESSURES

CROSS-REFERENCE TO RELATED APPLICATIONS

This application claims priority to U.S. Provisional Patent Application Ser. No. 62/112,985, filed on Feb. 6, 2015 entitled "AVERAGE/INITIAL RESERVOIR PRESSURE AND WELLBORE EFFICIENCY ANALYSIS FROM RATES AND DOWNHOLE PRESSURES," which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. Information from the wells can prove valuable, but reliably obtaining useful information from the well is difficult.

SUMMARY

In some embodiments, the present disclosure is related to an empirical analysis of using down hole pressures and rates (oil, gas, water) including surface rates when available, to estimate average reservoir pressure, initial reservoir pressure and reservoir/completion/wellbore efficiency of wells, zones and compartments where such tools are installed or data made available. In some embodiments, the present disclosure is directed to obtaining well measurements, such as reservoir effective permeability, net pay thickness, initial reservoir pressure, flow rate, viscosity, and formation volume factor. With these parameters in hand, plotting pressure (p) and flow rate (q) with p/q on a y-axis and 1/q on an x-axis provides insight into the well characteristics.

With the advancement in technologies increasing number of wells and zones now have both down hole pressure and rate measurements (also includes calculated rates) which sync over time and any transient pressure effects felt are easily seen in the rates measured.

Pressure and rate transient analysis are being used to estimate the average/initial reservoir pressure and reservoir/wellbore performance with techniques involving data acquisition and interpretation exercises that are designed and pre planned. The data acquired has to be interpreted and matched with type curves for obtaining the required parameters.

DETAILED DESCRIPTION

Figure 1:
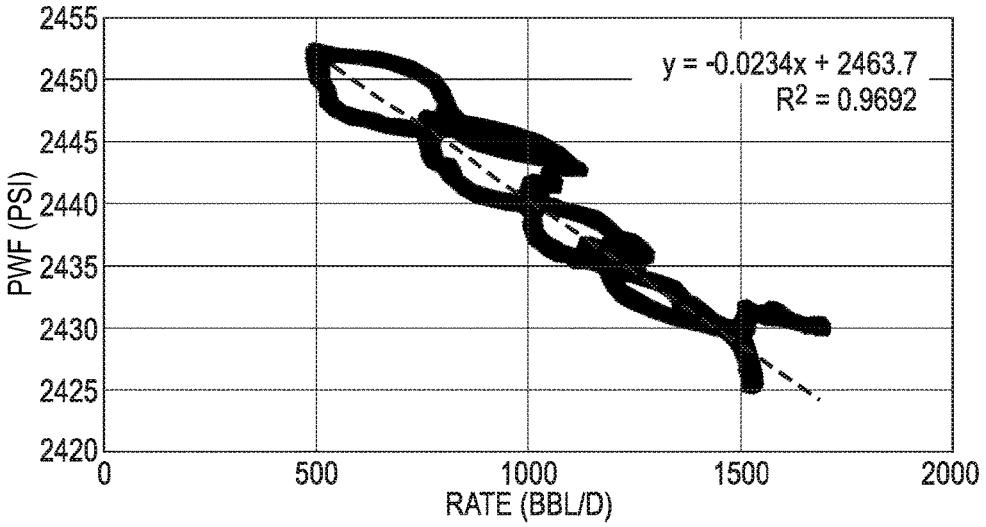
FIG. 1 (Prior Art)
FIG. 1 illustrates a plot of pwf/Q according to the prior art.

In the following description, numerous details are set forth to provide an understanding of the present disclosure. However, it will be understood by those skilled in the art that the embodiments of the present disclosure may be practiced without these details and that numerous variations or modifications from the described embodiments may be possible.

Evaluation of the initial reservoir pore pressure, the current average prevailing reservoir pressure, and the deliverability of a well commonly results in the need for one or more pressure or rate-transient tests of a well's performance to be conducted in order to properly characterize the properties of the reservoir and the well completion efficiency. Conventional pressure build up or multi-rate drawdown tests have commonly been used for this purpose. These types of transient tests can last for days or even months in low-permeability unconventional reservoirs, resulting in prohibitive production deferments and operational expenditure. The reservoir pressure and the well deliverability are key indices that are used to properly characterize the reservoir properties and the expected ultimate recovery of a well.

Embodiments of the present disclosure are directed to the development and application of an elegant production performance analysis technique that can be used to accurately determine the initial and/or average prevailing reservoir pressure of both conventional and unconventional reservoirs (for any permeability level), for wells of any type, time level, inner and outer boundary condition and flow regime, using only transient well production data (flow rates and bottom hole flowing pressures as a function of time). With the improvements in accuracy that can now be achieved in determining the average reservoir pressure, reliable and accurate transient Productivity Index values can be obtained for producing wells.

In addition to the improvement in determining the initial/average reservoir pressure, the newly developed production analysis procedure also provides an excellent means of Quality Control for the validity and consistency in the reported well flow rates as a function of the system drawdown. Examples include a variety of different flow rate measurement or estimation techniques have been utilized. These include a state-of-the-art advanced and extremely accurate surface multiphase flow rate metering system, flow rates computed from downhole flow control valve measurements, as well as an example in which well flow rates have been estimated using measurements obtained for monitoring the performance of an electrical submersible pump.

The acquisition of extremely accurate, high-frequency production performance data greatly enhances the evaluation of the reservoir pressure obtained with the analysis technique presented here. Temporal measurements of the sandface flowing pressures and flow rates, obtained for a time scale on the order of minutes or hours is often adequate for accurately determining the initial or current average reservoir pressure. However, the use of high-frequency production data obtained with permanent downhole gauges and surface (or downhole) continuous flow rate metering systems offer even greater precision in evaluating the reservoir pressure with this analysis.

The production performance of wells completed in oil and gas reservoirs can be used to characterize the intrinsic properties of the reservoir and to quantify the parameter values related to a well's completion efficiency. The intrinsic reservoir properties of interest include the formation effective conductivity to oil or gas and directional permeability anisotropy, dual porosity reservoir properties (if applicable), and the reservoir drainage area associated with each well. The well completion efficiency parameters that may be derived from an analysis of a well's production performance are specific to the type of well and may include the apparent radial flow steady state skin effect, fracture half-length and conductivity, the effective horizontal wellbore length in the pay zone, and the number of completed intervals contributing to flow.

In production data analyses of this type, an important and often one of the most difficult parameters to determine accurately and reliably is the initial or current prevailing average reservoir pressure of the reservoir drainage area that is associated with a well. A number of investigations have been reported in the literature concerning various techniques for estimating the initial (and average) reservoir pressure associated with a well's drainage area using multirate drawdown or pressure buildup transient data. Prior to discussing the details of the newly-developed production performance analysis technique for evaluating the initial or average reservoir pressure of this work, a brief historical review of the various classical analysis techniques that have been proposed for estimation of the reservoir pressure of a well's drainage area using multirate drawdown and pressure buildup transient data is given. The comparison of the classical reservoir pressure estimation techniques that are available in the industry with the much simpler and straightforward initial and average reservoir pressure evaluation technique that has been developed in this study demonstrates how elegant the new reservoir pressure evaluation procedure is.

Perhaps the earliest analysis technique that was proposed for estimating the average reservoir pressure from a well's pressure buildup response was given by Muskat (1937). A graph of the logarithm of the difference between the average reservoir pressure and the sandface shutin pressure [log ($p^{-}$_r−p_ws)] versus the shutin time (□t) for the late-time shutin transient data will result in a straight line which can be used to evaluate the shutin well response. Arps and Smith (1949) also reported an analysis technique for estimating the average reservoir pressure in a well's reservoir drainage area using the well's pressure buildup behavior. The Arps and Smith (1949) method consists of plotting the derivative of the sandface shutin pressure with respect to time versus the shutin time of the late-time behavior of a well, which can be extrapolated to obtain an estimate of the average reservoir pressure. The analysis techniques originally proposed by Muskat (1937) and Arps and Smith (1949) are not generally used at the current time for estimating the average reservoir pressure from a well's pressure buildup response due to the generally quite long shutin times that are required for these analyses.

A modification of the original Muskat (1937) analysis proposed by Larson (1963) has been found to significantly reduce the amount of shutin time that is required in the Muskat (1937) analysis and has made the Modified Muskat method a more practical analysis technique for estimating the average reservoir pressure of a well using pressure buildup data. Larson's (1963) modification of Muskat's (1937) analysis involves the assumption that boundary effects have been exhibited in the well performance, in which case an approximate solution for the pressure buildup response of a well produced at constant rate prior to shutin for the pressure buildup transient in a closed cylindrical reservoir may be used. The modification of Muskat's (1937) method given by Larson (1963) still involves a trial-and-error procedure of a semilog graphical analysis of log ($p^{-}$_r−p_ws) versus □t with various trial values of average reservoir pressure ($p^{-}$_r). The shutin time domain over which the Modified Muskat analysis will result in a computed straight line response for a correctly selected average reservoir pressure value is between (250ϕc_t_r_e^2)/k and (750ϕc_t_r_e^2)/k. Additional details of the Modified Muskat analysis may be found in Lee (1982).

Other evaluation techniques that have been developed for estimating the average reservoir pressure within the reservoir drainage area of a well are the Miller, Dyes, and Hutchinson (1950), Homer (1951 and 1955), Matthews, Brons, and Hazebroek (1954), and Dietz (1961) methods. The Miller, Dyes, and Hutchinson (1950) analysis is commonly denoted in the industry literature as the MDH method and the average reservoir pressure analysis proposed by Matthews, Brons, and Hazebroek (1954) is also generally referred to as the MBH method. Note that these analyses assume that the pressure buildup transient is of sufficient shutin duration as to be able to observe the infinite-acting radial (or pseudoradial) flow regime. The two most commonly used of these analyses are the Homer (1951 and 1955) and the MBH methods with the basic background for each of these analyses discussed in the following for proper context.

The reservoir pressure level of a well's drainage area is perhaps one of the most important reservoir parameters. Accurate values of the reservoir pressure are required for most all of the reservoir engineering analyses that we have, including the determination of a well's deliverability, the initial reservoir fluids-in-place and reserves estimates, proper characterization of the reservoir intrinsic properties, and the completion effectiveness to name just a few of its applications. Traditionally, the average reservoir pressure (or initial pressure) has been determined almost exclusively with the analysis of the shutin pressure buildup behavior of a well. The rare exception of this rule has been a two-rate drawdown analysis reported by Lee (1982). In practice, it is not practical or at least highly undesirable to shut a well in for a pressure buildup transient test due to the prohibitive loss of production, transient test duration, and cost.

The disclosed embodiments include a novel analysis technique for determining the initial and average reservoir pressure of a well's drainage area using the transient production performance of the well. It has been demonstrated by theory and with field examples that the reciprocal flow rate and cumulative production analyses are applicable for the analysis of the sandface flowing pressure and corresponding well flow rate or cumulative production performance of all types of wells since it is derived directly from the fundamental definition of the dimensionless wellbore pressure. The solutions of the present disclosure are applicable for liquid and multiphase flow reservoir analyses. The reciprocal flow rate analysis disclosed herein for the evaluation of reservoir pressure has also been demonstrated to provide an excellent means to QC the consistency of the reported well flow rates for measured pressure drawdowns.

The reciprocal flow rate analysis developed in this study has been derived from fundamental, transient fluid flow theory and provides a rigorous method for determining the reservoir pressure of a well's drainage area using the well's transient production rate and wellbore flowing pressure data.

A modification of the reciprocal flow rate analysis for determining the reservoir pressure has also been developed in terms of the reciprocal cumulative production, which extends the applicability of the reservoir pressure evaluation technique to analyses of production data with constant well flow rate histories, or in cases where the well flow rates are less accurately known which may be difficult to evaluate with the reciprocal flow rate analysis technique alone.

The reservoir pressure analysis technique disclosed herein provides a technical basis for determining the consistency and accuracy of reported well flow rates that correspond to the measured wellbore flowing pressure drawdowns.

The reservoir pressure analysis methodology developed in this investigation uses transient flowing well production data and does not require that the well be shutin for a pressure buildup transient in order to determine the average reservoir pressure.

A qualitative analysis of the transient apparent Productivity Index can also be deduced using this reservoir pressure evaluation technique. If pseudosteady state conditions exist, the Productivity Index can be directly determined using the average reservoir pressure values determined with the reciprocal flow rate or cumulative production analyses given herein.

Embodiments of the present disclosure are directed to an approach of using the dimensionless wellbore pressure equation:

$$PwD=kh(Pi-Pwf)/141.205q\mu B \quad 1$$

By re-arranging equation . . . 1

$$Pwf/q=Pi(1/q)-141.205\ \mu BPwD/kh \quad 2$$

The graphical analysis of the above equation 2 is made possible by obtaining down hole pressure and rates (measured and calculated). The ratio of Pwf/q when plotted on y-axis with 1/q on x-axis, the slope of the cross plot yields average reservoir pressure, while initial reservoir pressure can be derived if production and rate history of the well is available since the start of the reservoir production.

The intercept is a conglomeration of many parameters which includes time, reservoir intrinsic properties (k and A), well completion effectiveness (S, Xf, Lh, Xe/Ye, Xw, Yw, Zw, etc). The intercept when tracked in real time will give an indication of changes in reservoir/wellbore performance which can be further evaluated to design a proper remedial plan for reviving the well production.

In certain embodiments of the present disclosure, variables shown in the above description and in the claims are as follows:

A Drainage area of well, $ft^2$ $B_g$ Gas formation volume factor, rcf/scf $B_o$ Oil formation volume factor, rb/STB $B_w$ Water formation volume factor, rb/STB $C_A$ Dietz steady state shape factor $C_f$ Formation pore compressibility, 1/psia $c_g$ Gas compressibility, 1/psia $c_o$ Oil compressibility, 1/psia $c_t$ Total system compressibility, 1/psia $$c_t=S_oc_o+S_wc_w+S_gc_g+c_f$$

$c_w$ Reservoir brine compressibility, 1/psia $G_p$ Cumulative gas production, MMscf h Reservoir net pay thickness, ft J Productivity Index under pseudosteady state flow, STB/D/psi $J_a$ Apparent Productivity Index under transient flow conditions, STB/D/psi $k_g$ Reservoir effective permeability to gas, md $k_o$ Reservoir effective permeability to oil, md $k_w$ Reservoir effective permeability to water, md $L_c$ System characteristic length, ft $L_c=r_w$ for unfractured vertical well $L_c=X_f$ for vertically fractured well $L_c=L_h/2$ for horizontal wellbore $L_h$ Horizontal wellbore effective completed length in pay zone, ft m Pressure buildup analysis middle time region (infinite-acting radial or pseudoradial flow) slope, psi/log cycle time N Original oil-in-place, STB n Number of flow rate measurement values in multirate production history $N_p$ Cumulative oil production, STB "False" initial pressure estimate, psia $p_D$ Dimensionless pressure $p_{DMBH}$ MBH dimensionless pressure $p_{DMDH}$ MDH dimensionless pressure $p_e$ Reservoir pressure at external boundary, psia $p_i$ Initial reservoir pressure, psia $\bar{p}_r$ Average reservoir pressure, psia $p_w$ Wellbore pressure, psia $p_{wD}$ Dimensionless wellbore pressure $p_{wf}$ Sandface flowing pressure, psia $p_{wmax}$ Maximum recorded wellbore pressure, psia $p_{ws}$ Sandface shutin pressure, psia $p_{1hr}$ Extrapolated pressure buildup analysis semilog straight line value at unity time function value, psia q Reservoir flow rate, rb/D $$q=q_oB_o+q_wB_w+(1000\ q_g-q_oR_{so}-q_wR_{sw})B_g/5.6146$$

$q_D$ Dimensionless flow rate $q_g$ Gas flow rate, Mscf/D $q_o$ Oil flow rate, STB/D $Q_p$ Reservoir total cumulative production, rb $$Q_p=N_pB_o+W_pB_w+(1000000\ G_p-N_pR_{so}-W_pR_{sw})B_g/5.6146$$

$q_r$ Reference reservoir flow rate, rb/D $q_w$ Water flow rate, STB/D $r_e$ Well drainage radius, ft $R_{so}$ Solution gas-oil ratio, scf/STB $R_{sw}$ Solution gas-water ratio, scf/STB $r_w$ Wellbore radius, ft s Steady state skin effect $S_g$ Reservoir gas saturation, fraction PV $S_o$ Reservoir oil saturation, fraction PV $S_w$ Reservoir water saturation, fraction PV t Time, hrs $t_D$ Dimensionless time $t_p$ Pseudoproduction time, hrs $t_{pD}$ Dimensionless pseudoproduction time, referenced to $L_c$ $t_{pDA}$ Dimensionless pseudoproduction time, referenced to A $X_f$ Fracture half-length, ft $W_p$ Cumulative water production, STB Greek $\Delta t$ Shutin time duration of transient, hrs $\Delta t_{DA}$ Dimensionless shutin time $\Delta t_{Dietz}$ Shutin time at which to evaluate $\bar{p}_r$ in the Dietz analysis, hrs $\phi$ Reservoir effective porosity, fraction BV $\lambda_t$ Total mobility, and/cp $$\lambda_t = \frac{k_o}{\mu_o} + \frac{k_w}{\mu_w} + \frac{k_g}{\mu_g}$$

$\mu_g$ Gas viscosity, cp $\mu_o$ Oil viscosity, cp $\mu_w$ Brine viscosity, cp

Figure 2:
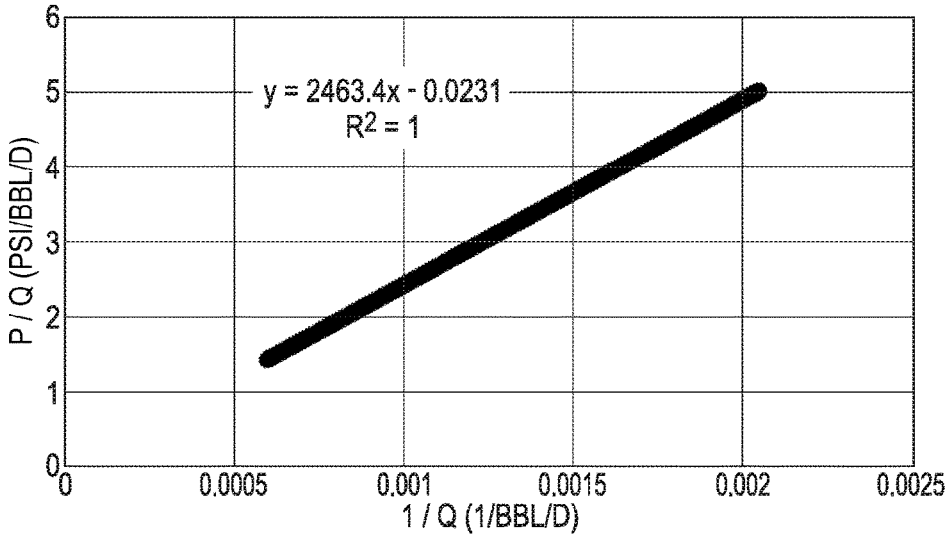
FIG. 2 illustrates a plot of p/q to 1/q according to embodiments of the present disclosure.

FIG. 1 is an example of the data plotted to compare traditional IPR approach. FIG. 2 illustrates the average reservoir pressure and reservoir/completion efficient at the sand face according to embodiments of the present disclosure.

According to embodiments of the present disclosure, the RMS error is zero wherein the traditional approaches have some RMS error. Transient effects felt by the pressure gauge and rates are nullified with the new approach according to embodiments of the present disclosure.

A similar analysis was performed on a separate well with slugging flow regime. Traditionally it would be impossible to analyze this kind of data unless some averaging or noise-removal technique is implemented.

Figure 3:
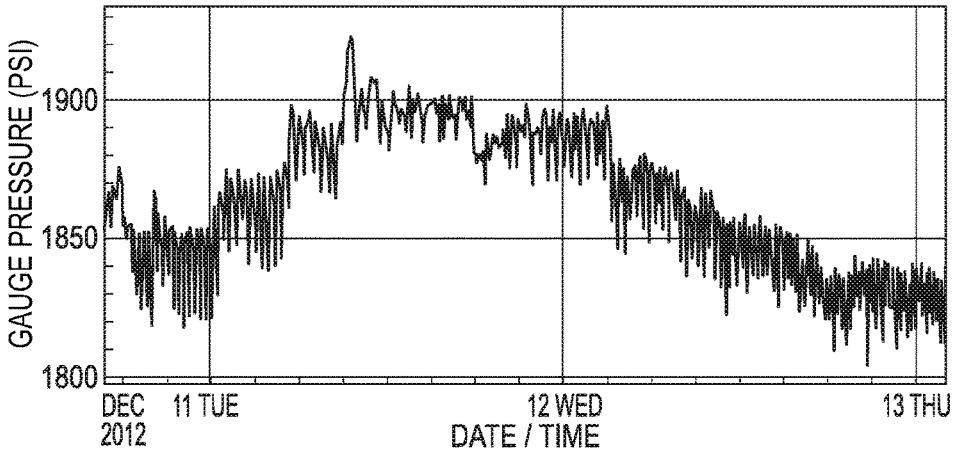
FIG. 3 is a chart of slugging data according to embodiments of the present disclosure.

FIG. 3 shows the data of pressure gauge vs time during the flow period according to embodiments of the present disclosure.

Figure 4:
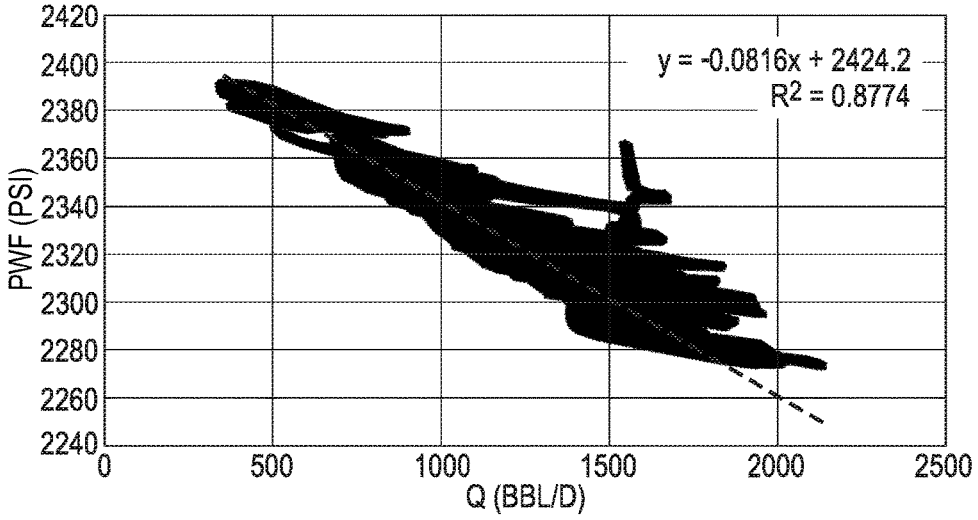
FIG. 4 (Prior Art)
FIG. 4 is a plot of P/Q according to the prior art.
Figure 5:
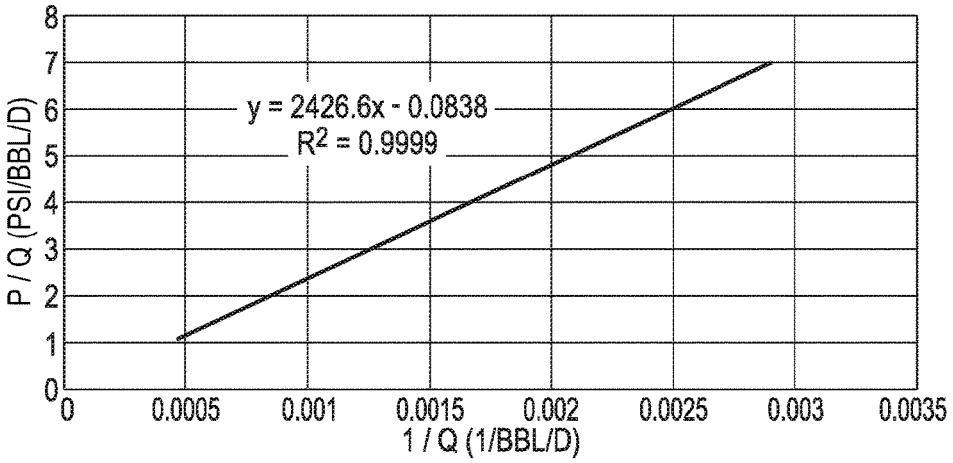
FIG. 5 is a plot of p/q to 1/q according to embodiments of the present disclosure.

FIG. 4 illustrates a traditional approach according to the prior art. FIG. 5 illustrates embodiments of the present disclosure. FIG. 5 shows an approach according to embodiments of the present disclosure in the case of slugging data. The new approach results show promising results in deriving average reservoir pressure and reservoir/completion efficiency at the wellbore with RMS error equivalent to zero.

In the above two scenarios data from down hole pressure gauge data and down hole flow rate measurements were used to test this approach according to the equations listed above.

Figure 6:
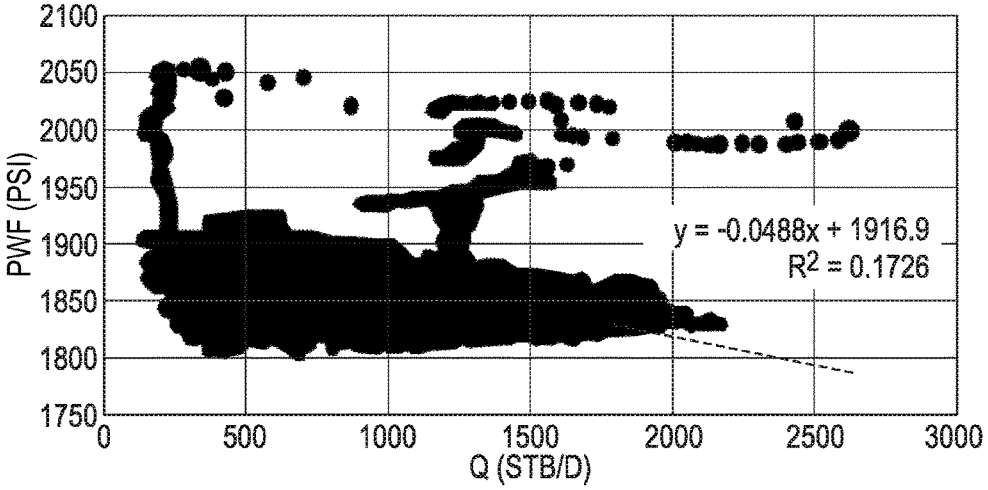
FIG. 6 is a plot of Pwf/Q according to the prior art.
Figure 7:
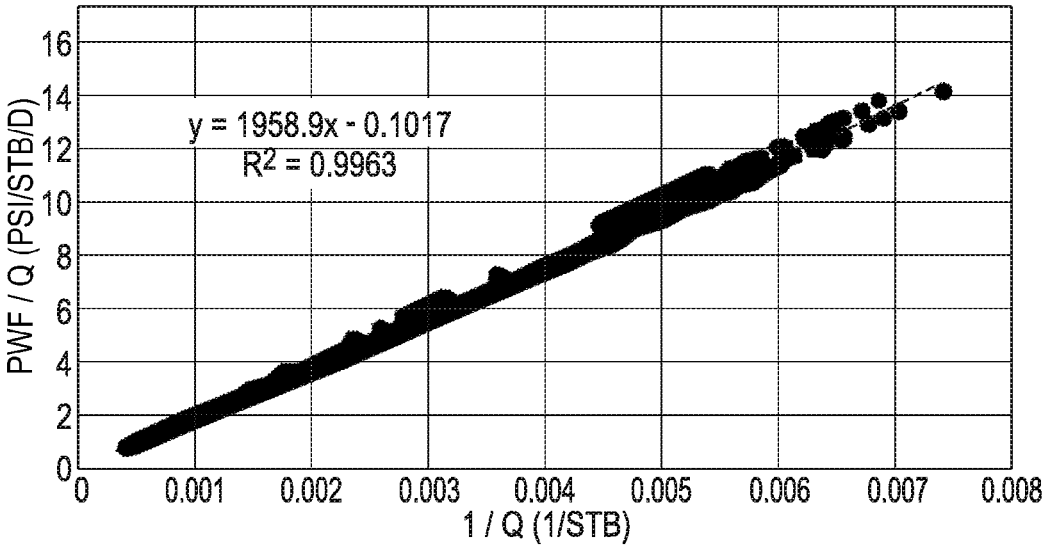
FIG. 7 is a plot of Pwf/Q to 1/Q according to embodiments of the present disclosure.

FIG. 6 illustrates traditional data measurements, and FIG. 7 shows the data received using the new approach according to embodiments of the present disclosure using a new data set with downhole gauge data and surface rates information from a flow meter is tested with both the approaches. This technique uses IPR to obtain average reservoir pressure (at gauge depth) and reservoir/completion efficiency at sand face (surface data).

Comparing the above two, it shows clearly that the data once thought to be uninterpretable without noise-removal and averaging, is possible today with this new approach to produce better accuracy results. The approach is further applicable to unconventional reservoirs and gas wells.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A method of characterizing parameters of a reservoir, comprising:

acquiring transient well production data for a well producing fluid from the reservoir;

using the transient well production data for obtaining a reservoir pressure, p, for the reservoir and a reservoir flow rate, q;

plotting p/q on a first axis, and 1/q on a second axis wherein the plot of p/q and 1/q comprises a first time and a second time;

using the plot, while producing fluid from the reservoir, identifying a change in reservoir characteristics between the first time and the second time; and based on the identified change, controlling well completion components to enhance producing fluid from the reservoir.

2. The method of claim 1, further comprising formulating a remedial plan to address issues in well performance.

3. A method of reviving a reservoir, comprising:

acquiring transient well production data for a well producing fluid from the reservoir;

using the transient well production data for:

obtaining a reservoir effective permeability, k, a reservoir net pay thickness, h, an initial reservoir pressure, Pi, a reservoir flow rate, q, a viscosity of oil in the well, μ, and a formation volume factor, B;

calculating a dimensionless parameter for wellbore pressure, PwD; and calculating a number Pwf/q, according to the equation:

$Pwf/q=Pi(1/q)-C\mu BPwD/kh$, wherein $C$ is a constant;

plotting the parameters p and q with p/q on a y-axis and 1/q on the x-axis wherein the plot of p/q and 1/q is monitored with respect to time to determine changes in the reservoir characteristics; and based on the determined changes, reviving well production from the reservoir.

4. A method comprising:

acquiring wellbore flow rate data and wellbore pressure data of a wellbore of a well in fluid communication with a reservoir with respect to time;

determining a slope and an intercept of a line using points in time for the wellbore pressure data divided by the wellbore flow rate data with respect to reciprocal wellbore flow rate data, wherein the division of the wellbore pressure data by the wellbore flow rate data and the reciprocal wellbore flow rate increase a coefficient of determination of the line, wherein the slope corresponds to an average reservoir pressure with respect to time and wherein the intercept corresponds to reservoir characteristics with respect to time;

while producing fluid from the well, determining a change in reservoir characteristics with respect to time using the intercept; and reviving production of fluid from the well using the change in reservoir characteristics with respect to time.

5. The method of claim 4 wherein the reservoir characteristics depend on a reservoir effective permeability, k, and the change corresponds to a change in the reservoir effective permeability.

6. The method of claim 4 wherein the reservoir characteristics depend on a reservoir net pay thickness, h, and the change corresponds to a change in the reservoir effective permeability.

7. The method of claim 4 wherein the reservoir characteristics depend on a formation volume factor, B, and the change corresponds to a change in the reservoir effective permeability.

8. The method of claim 4 wherein acquiring the wellbore pressure data comprises receiving the wellbore pressure data from a downhole pressure gauge.

9. The method of claim 4 wherein acquiring the wellbore flow rate data comprises receiving the wellbore flow rate data from a downhole flow meter.

10. The method of claim 4 wherein acquiring the wellbore flow rate data comprises receiving the wellbore flow rate data from a surface flow meter.

11. The method of claim 4 wherein the wellbore pressure data comprise sandface flowing pressure data.

12. The method of claim 4 comprising determining an initial reservoir pressure value using the slope and wellbore flow rate data that extends in time to a start of fluid production from the well.

13. The method of claim 4 comprising tracking the intercept in real time as an indicator of changes in reservoir/wellbore performance.

14. The method of claim 4 comprising tracking the intercept in real time as an indicator of changes in well completion effectiveness.

15. The method of claim 4 wherein the acquiring wellbore flow rate data and wellbore pressure data and the determining a change in reservoir characteristics with respect to time using the intercept are performed in real time.

16. The method of claim 15 wherein the acquiring wellbore flow rate data and wellbore pressure data and the determining a change in reservoir characteristics with respect to time using the intercept are performed without shutting in the well.

17. The method of claim 4 wherein the acquiring wellbore flow rate data and wellbore pressure data and the determining a change in reservoir characteristics with respect to time using the intercept are performed without shutting in the well.

* * * * *